US012716231B2

(12) United States Patent
Cartwright

(10) Patent No.: US 12,716,231 B2
(45) Date of Patent: Aug. 25, 2026

(54) SYSTEM AND METHOD OF ATTACHING PRECAST PANELS

(71) Applicant: BARSPLICE PRODUCTS, INC., Dayton, OH (US)

(72) Inventor: Timothy L. Cartwright, Tipp City, OH (US)

(73) Assignee: Barsplic Products, Inc., Dayton, OH (US)

( * ) Notice: Subject to any disclaimer, the term of this patent is extended or adjusted under 35 U.S.C. 154(b) by 199 days.

(21) Appl. No.: 18/392,136

(22) Filed: Dec. 21, 2023

(65) Prior Publication Data

US 2024/0125113 A1 Apr. 18, 2024

Related U.S. Application Data

(63) Continuation-in-part of application No. 29/807,830, filed on Sep. 15, 2021, now Pat. No. Des. 1,074,387.

(51) Int. Cl.
*E04B 1/41* (2006.01)
*E04B 1/61* (2006.01)

(52) U.S. Cl.
CPC ..... *E04B 1/4121* (2013.01); *E04B 1/612* (2013.01)

(58) Field of Classification Search
CPC . E04C 5/16; E04C 5/162; E04C 5/163; E04C 5/165; E04C 5/122; E04C 5/12; E04C 5/125; E04B 1/41; E04B 1/4114; E04B 1/4121; E04B 1/61; E04B 1/612; E04B 1/6166; E04G 17/0721; E04G 21/121; F16B 7/04; F16B 7/0406
See application file for complete search history.

(56) References Cited

U.S. PATENT DOCUMENTS 1,797,194 A 3/1931 Knapp
3,049,775 A * 8/1962 Ondeck ..... E04C 5/165 425/111

(Continued)

FOREIGN PATENT DOCUMENTS

CN 87301263 8/1988
CN 303384342 9/2015

(Continued)

OTHER PUBLICATIONS

Field Installed Threaded Termination Headed Reinforcement, Brochure Date: Jun. 27, 2023, image retrieved on Oct. 19, 2023, <https://www.barsplice.com/Brochures/FITT_Brochure.pdf>.

*Primary Examiner* — Jessica L Laux
(74) *Attorney, Agent, or Firm* — Jacox, Meckstroth & Jenkins

(57) ABSTRACT

A system and method for attaching precast panels and for coupling a plurality of reinforcing bars together. The system and method have a plurality of reinforcing bar coupler assemblies as shown to mechanically splice reinforcing bars of two precast panels or a plurality of reinforcing bars together to provide a permanent means of connecting the panels. Each of the reinforcing bar coupler assemblies have a first component, clamp ring, insert and second component and spring that are assembled and used to couple a plurality of reinforcing bars together. The reinforcing bar coupler assembly is precast into precast panels that are then adapted to be mounted and coupled together using the reinforcing bar coupler assemblies.

20 Claims, 8 Drawing Sheets

(56) References Cited

U.S. PATENT DOCUMENTS

| | | | | |
|---|---|---|---|---|
| 3,253,332 | A | 5/1966 | Howlett et al. | |
| 3,361,460 | A | 1/1968 | Jansen | |
| 3,676,899 | A | 7/1972 | Ehlert | |
| 3,952,377 | A | 4/1976 | Morell | |
| 4,192,215 | A | 3/1980 | Hymans | |
| 5,308,184 | A | 5/1994 | Bernard | |
| 5,383,740 | A | 1/1995 | Lancelot, III | |
| 5,606,839 | A | 3/1997 | Baumann | |
| 5,729,952 | A | 3/1998 | Dahl | |
| 5,974,761 | A | 11/1999 | Mochizuki et al. | |
| 6,023,894 | A | 2/2000 | Sorkin | |
| 6,065,263 | A * | 5/2000 | Taguchi | F16B 7/06 52/583.1 |
| 6,192,647 | B1 | 2/2001 | Dahl | |
| 6,240,697 | B1 | 6/2001 | Thompson et al. | |
| 6,513,287 | B1 | 2/2003 | Sorkin | |
| 6,604,882 | B2 | 8/2003 | Gordon et al. | |
| 6,626,610 | B1 | 9/2003 | Seegmiller | |
| 6,817,148 | B1 | 11/2004 | Sorkin | |
| 7,032,286 | B2 | 4/2006 | Wang | |
| 7,424,792 | B1 | 9/2008 | Sorkin | |
| D583,224 | S | 12/2008 | Holdsworth | |
| D588,445 | S | 3/2009 | Holdsworth | |
| 7,765,752 | B2 | 8/2010 | Hayes et al. | |
| 7,841,061 | B1 | 11/2010 | Sorkin | |
| 7,975,444 | B2 | 7/2011 | Holdsworth et al. | |
| 8,051,615 | B2 * | 11/2011 | Mathews | F16G 11/106 52/223.13 |
| RE43,194 | E | 2/2012 | Toimil | |
| 8,413,396 | B2 | 4/2013 | Oliva et al. | |
| 9,091,064 | B1 * | 7/2015 | Dahl | E04C 5/122 |
| 9,551,151 | B2 | 1/2017 | Lee et al. | |
| 9,657,453 | B1 | 5/2017 | Shin | |
| 10,385,569 | B2 | 8/2019 | Yang et al. | |
| 10,640,978 | B2 * | 5/2020 | Sorkin | E01F 15/06 |
| 11,028,588 | B2 * | 6/2021 | Lee | F16B 7/0406 |
| 11,391,344 | B1 * | 7/2022 | Sargent | F16G 11/106 |
| 11,732,479 | B2 | 8/2023 | Park et al. | |
| 12,085,120 | B2 * | 9/2024 | Cha | E04C 5/165 |
| 2007/0175128 | A1 | 8/2007 | McCallion | |
| 2008/0302035 | A1 | 12/2008 | Shin | |
| 2014/0105678 | A1 * | 4/2014 | Lim | F16B 7/025 403/342 |
| 2014/0223854 | A1 | 8/2014 | Gilling et al. | |
| 2016/0208492 | A1 | 7/2016 | Kim | |
| 2017/0081853 | A1 * | 3/2017 | Kim | E04C 5/165 |
| 2017/0204608 | A1 | 7/2017 | Yang et al. | |
| 2018/0030832 | A1 | 2/2018 | Abreu et al. | |
| 2018/0187418 | A1 | 7/2018 | Prowse | |
| 2019/0093362 | A1 | 3/2019 | Lee | |
| 2019/0234443 | A1 * | 8/2019 | Man | F16B 7/182 |
| 2019/0345717 | A1 * | 11/2019 | Kang | F16B 7/0426 |
| 2020/0071932 | A1 | 3/2020 | Park | |
| 2020/0157819 | A1 | 5/2020 | Lee et al. | |
| 2020/0340250 | A1 | 10/2020 | Cross et al. | |
| 2021/0214932 | A1 | 7/2021 | Monty et al. | |
| 2021/0262218 | A1 | 8/2021 | Kang et al. | |
| 2022/0032360 | A1 | 2/2022 | Kuo | |
| 2023/0008119 | A1 * | 1/2023 | Cha | F16B 7/0426 |

FOREIGN PATENT DOCUMENTS

| | | |
|---|---|---|
| CN | 308264389 | 10/2023 |
| CN | 308264389 S | 10/2023 |
| KR | 300628344 | 1/2012 |
| KR | 300628343 | 3/2012 |
| WO | WO D202353 | 11/2019 |

* cited by examiner

12b1
12b
12b2
22b
22
36
30
34
26
32
14
31
12a1
12a
12a2

SYSTEM AND METHOD OF ATTACHING PRECAST PANELS

CROSS-REFERENCE TO RELATED APPLICATIONS

The present application is a continuation-in-part of U.S. Design application Ser. No. 29/807,830, filed Sep. 15, 2021. This application is incorporated herein by reference and made a part hereof.

BACKGROUND OF THE INVENTION

1. Field of the Invention

This invention relates to a system and method for attaching precast panels together and for coupling a plurality of reinforcing bars together, and more particularly, it relates to a reinforcing bar coupler assembly that is used to mechanically splice reinforcing bars of two precast panels or a plurality of reinforcing bars together to provide a permanent means of connecting the panels.

2. Description of the Related Art

In the field of construction of structures, it is not uncommon that precast concrete panels are used. The concrete panels are typically precast at a facility and then transported to a job site and then coupled or stacked together to form, for example, a wall of the structure.

As is well known, the precast concrete panels are typically precast with a plurality of reinforcing bars, commonly referred to as "rebars", for example, of the general type disclosed in U.S. Pat. No. 7,975,444; D 583,224 and D 588,445, which are issued to the same Assignee as the present invention, each of which are incorporated herein by reference and made a part hereof. Other related prior art includes U.S. Pat. Nos. 5,383,740; 5,606,839; 5,974,761; 6,192,647; 8,413,396; 9,091,064 and 11,732,479.

During the coupling of the panels and the reinforcing bars together, it is extremely important for the reinforcing bars to be securely fastened together in order to securely couple the panels together, thereby increasing the tensile strength of the concrete panels and the walls in order to facilitate preventing cracking and breaking.

With coupling systems of the past, it was oftentimes necessary and critical to very accurately align mating panels, which typically required nearly exact reinforcing bar placement in the panels so that they are easily mounted together. Unfortunately, achieving exact placement of the reinforcing bars is difficult.

In some applications of the past, a plurality of panels were stacked or mounted together and a sleeve was used in combination with grout that was pumped into the sleeve to secure the panels together. This typical procedure was often time consuming, especially waiting for the grout to cure prior to removal of any panel support structure that was necessary to support the panels during such curing process.

What is needed, therefore, is an improved system and method of attachment of a plurality of reinforcing bars and a plurality of precast panels.

SUMMARY OF THE INVENTION

A primary object of the invention is to provide a system and method for splicing reinforcing bars of two precast panels together by providing a permanent means of connecting the two precast panels to define a wall or structure.

Another object of the invention is to provide a system and method for allowing a plurality of precast panels to be precast with a threaded reinforcing bar having a reinforcing bar coupler assembly threadably coupled thereto, both of which are precast in the panel.

Another object of the invention is to provide a reinforcing bar coupler assembly adapted to couple a plurality of reinforcing bars together, and when used in a precast panel, permitting the precast panels to be coupled together.

Another object of the invention is to provide a system, method and apparatus for easily coupling precast panels together at a job site using a reinforcing bar coupler assembly.

Another object of the invention is to provide a system and method that is adapted to allow for variability in placing of the reinforcing bars during casting of the precast panels.

Still another object of the invention is to provide an attachment assembly and method for coupling reinforcing bars together and also for coupling precast panels together.

Another object of the invention is to provide a reinforcing bar coupler assembly and method that utilizes a first component that is adapted to receive clamp ring, insert and a spring and is urged by a second component that is mounted onto the first component to force the insert into the clamp ring such that it engages and clamps an end of a first reinforcing bar.

Yet another object of the invention is to provide a reinforcing bar coupler assembly that is adapted to be threadably mounted onto a first reinforcing bar and then coupled to a second reinforcing bar.

Another object of the invention is to provide a reinforcing bar coupler assembly that permits friendly or relatively large tolerances in coupling reinforcing bars from precast panels together.

Another object of the invention is to provide a reinforcing bar coupler assembly that is cast into a first precast panel and that is adapted to receive an end of a reinforcing bar from a second precast panel, thereby coupling the reinforcing bars and their associated precast panels together.

Another object of the invention is to provide a reinforcing bar coupler assembly that has a first component which has an internal receiving area for receiving a clamp ring that cooperate with insert to clamp against an end of a first reinforcing bar when the insert is urged by a spring into the clamp ring, thereby forcing the insert to engage and clamp against the end of the first reinforcing bar.

Another object of the invention is to provide a precast panel system and method that permits variable adjustment of the position of the reinforcing bar of the reinforcing bar coupler assembly along an axis of the first reinforcing bar and simultaneously permitting the reinforcing bar coupler assembly to permit radial adjustment so that when a first precast panel is mounted onto a second precast panel having a second reinforcing bar, the second end of the second reinforcing bar is adapted to be received in the reinforcing bar coupler assembly in a manner such that the axes of the first and second reinforcing bars do not have to be co-axial and may be offset, although they could be co-axial.

In one aspect, one embodiment of the invention comprises a reinforcing bar coupler assembly for coupling a plurality of reinforcing bars together, the reinforcing bar coupler assembly comprising a first component comprising an internal receiving area; clamp ring for situating in the internal receiving area, the clamp ring comprising an insert receiving area and defining a clamp ring passageway in communication with the insert receiving area and a clamp ring passageway axis, the clamp ring comprising a clamp ring tapered or frusto-conical inner surface; insert comprising an insert reinforcing bar receiving area defined by insert interior wall that is adapted and sized to receive a first one of the plurality of reinforcing bars in the insert receiving area, the insert having an insert axis that becomes generally aligned with or generally coaxial with the clamp ring passageway axis so that after the first one of the plurality of reinforcing bars is received in the insert reinforcing bar receiving area, the insert comprising an insert tapered outer surface that engages and cooperates with the clamp ring tapered or frusto-conical inner surface to cause the insert interior wall to apply a compressive force against a portion of the first one of the plurality of reinforcing bars in response to the insert being urged into the clamp ring; a second component for mounting onto the first component traveling along the clamp ring tapered or frusto-conical inner surface to travel along the clamp ring tapered or frusto-conical inner surface thereby causing the insert to engage and clamp against the portion of the first one of the plurality of reinforcing bars; the second component being adapted to be mounted to a threaded first end of a second one of the plurality of reinforcing bars so that after the reinforcing bar coupler assembly is mounted on the second one of the plurality of reinforcing bars and the first one of the plurality of reinforcing bars is secured or clamped to the second one of the plurality of reinforcing bars, the first one and the second one of plurality of reinforcing bars become coupled and secured together.

In still another aspect, another embodiment of the invention comprises a precast panel system for building a structure, the precast panel system comprising a first precast panel having a first reinforcing bar; a second precast panel having a second reinforcing bar; the second precast panel having a coupler assembly coupled to the first reinforcing bar so that an end of the first reinforcing bar may be inserted into the coupler assembly, thereby securing the first precast panel to the second precast panel; the coupler assembly comprising a first component comprising an internal receiving area; clamp ring for situating in the internal receiving area, the clamp ring comprising an insert receiving area and defining a clamp ring passageway in communication with the insert receiving area and a clamp ring passageway axis, the clamp ring comprising a clamp ring tapered or frusto-conical inner surface; insert comprising an insert reinforcing bar receiving area defined by insert interior wall that is adapted and sized to receive the first reinforcing bar in the insert receiving area, the insert having an insert axis that becomes generally aligned with or generally coaxial with the clamp ring passageway axis so that after the first reinforcing bar is received in the insert reinforcing bar receiving area, the insert comprising an insert tapered outer surface that engages and cooperates with the clamp ring tapered or frusto-conical inner surface to cause the insert interior wall to apply a compressive force against a portion of the first reinforcing bar in response to the insert being urged into the clamp ring; a second component for mounting onto the first component traveling along the clamp ring tapered or frusto-conical inner surface to travel along clamp ring tapered or frusto-conical inner surface thereby causing the insert to engage and clamp against the portion of the first reinforcing bar; the second component being adapted to be mounted to a threaded first end of the second reinforcing bar so that after the coupler assembly is mounted on the second reinforcing bar and the first reinforcing bar is secured or clamped to the second reinforcing bar, the first and second reinforcing bars become coupled and secured together.

In another aspect, another embodiment of the invention a method of making a coupler adapted to rigidly connect end portions of a first reinforcing bar and a second reinforcing bar, the first and second reinforcing bars being adapted to be used with concrete, the method comprising the steps of providing a first component comprising an internal receiving area; situating a clamp ring into the internal receiving area, the clamp ring comprising a clamp ring receiving area defined by a clamp ring tapered inner surface; situating insert into the clamp ring receiving area, the insert comprising an insert receiving area defined by an insert interior wall that is adapted and sized to receive an end portion of the first reinforcing bar in the insert receiving area, the insert further comprising an insert tapered outer surface that engages and cooperates with the clamp ring tapered inner surface to cause the insert interior wall to wedge against and engage the clamp ring tapered inner surface against the insert tapered outer surface thereby causing the insert to clamp against and be secured to the first reinforcing bar; mounting a second component onto the an end portion of the second reinforcing bar; mounting the second component to the first component; and wherein when the insert is driven axially into the clamp ring, the insert tapered outer surface travels and wedges against the clamp ring tapered inner surface to cause the first component to edge against and clamp against the end portion of the first reinforcing bar.

This invention, including all embodiments shown and described herein, could be used alone or together and/or in combination with one or more of the features covered by one or more of the following list of features:

- The reinforcing bar coupler assembly wherein the insert is a split ring assembly that cooperates to secure or clamp against a portion of the first one of the plurality of reinforcing bars in response to the insert being urged axially in the clamp ring.
- The reinforcing bar coupler assembly wherein the insert is split, the reinforcing bar coupler assembly comprising a spring that engages and the spring urges the insert until it engages and clamps against the portion of the first one of the plurality of reinforcing bars.
- The reinforcing bar coupler assembly wherein the insert is split, the spring being situated between the second component and the insert so that when second component is mounted to the first component, the second component engages the spring and urges the insert tapered outer surface to travel along the clamp ring tapered or frusto-conical inner surface to engage and force the insert to clamp onto the portion of the first one of the plurality of reinforcing bars, thereby securing the first one of the plurality of reinforcing bars to the second one of the plurality of reinforcing bars.
- The reinforcing bar coupler assembly wherein the insert is received in the clamp ring and the spring applying an axial force to the insert when the second component is mounted onto the first component.
- The reinforcing bar coupler assembly wherein the second component comprises a threaded aperture adapted to receive a threaded end of the second one of the plurality of reinforcing bars.
- The reinforcing bar coupler assembly wherein the insert comprising a first insert and a second insert, the first and second inserts cooperating to define the insert, each of the first and second insert portions comprising a generally curved inner wall or surface for engaging and applying a clamping force against the portion of the first one of the plurality of reinforcing bars, each of the first and second inserts also having a tapered wall portion that cooperate to define the insert tapered outer surface.

The reinforcing bar coupler assembly wherein first and second inserts further comprise a shoulder adapted to receive and support a spring, thereby enabling the insert to be received in the clamp ring so that the spring may apply an axial driving force to the first and second inserts when the second component is mounted onto the first component.

The reinforcing bar coupler assembly wherein the generally curved inner wall or surface comprises teeth or projections for engaging the first one of the plurality of reinforcing bars.

The reinforcing bar coupler assembly wherein the insert and the clamp ring are dimensioned and adapted to permit the insert to move within the clamp ring to accommodate and allow for variability in placing of the first one of the plurality of reinforcing bars into the reinforcing bar coupler assembly.

The reinforcing bar coupler assembly wherein a first precast panel is precast with a plurality of protruding ends of reinforcing bars that are threadably mounted to a first reinforcing bar coupler assembly; a second precast panel also having a plurality of protruding ends of reinforcing bars extending therefrom; the second precast panel adapted to be aligned with the first reinforcing bar coupler assembly of the first precast panel so that when the second precast panel is mounted in the first precast panel, the plurality of protruding ends of reinforcing bars become received in the first reinforcing bar coupler assembly of the first precast panel to which it is aligned.

The precast panel system wherein the insert is a split ring assembly that cooperates to secure or clamp against a portion of the first reinforcing bar in response to the insert being urged axially in the clamp ring.

The precast panel system wherein the insert is split, the coupler assembly comprising a spring that engages and urges the insert until it engages and clamps against the portion of the first reinforcing bar.

The precast panel system wherein the insert is split, a spring being situated between the second component and the insert so that when second component is mounted to the first component, the second component engages the spring and the spring urges the insert tapered outer surface to travel along the clamp ring tapered or frusto-conical inner surface to engage and force the insert to clamp onto the portion of the first reinforcing bar, thereby securing the first reinforcing bar to the second reinforcing bar.

The precast panel system wherein the insert is received in the clamp ring and a spring applying an axial force to the insert when the second component is mounted onto the first component.

The precast panel system wherein the second component comprises a threaded aperture adapted to receive a threaded end of the second reinforcing bar.

The precast panel system wherein the insert comprising a first insert portion and a second insert portion, the first and second insert portions cooperating to define the insert, each of the first and second insert portions comprising a generally curved inner wall for engaging and applying a clamping force against the portion of the first reinforcing bar when the second component is mounted onto the first component, each of the first insert portion and the second insert portion also having a tapered wall portion that cooperate to define the insert tapered outer surface.

The precast panel system wherein first and second inserts further comprise a shoulder adapted to receive and support a spring, thereby enabling the insert to be received in the clamp ring so that a spring may apply an axial driving force to the insert when the second component is mounted onto the first component to clamp the coupler assembly to the first reinforcing bar.

The precast panel system wherein the insert comprises teeth for engaging the first reinforcing bar is received in the clamp ring and a spring applying an axial force to the insert when the second component is mounted onto the first component.

The precast panel system wherein the insert and the clamp ring are dimensioned and adapted to permit the insert to move within the clamp ring to accommodate allow for variability in placing of the first reinforcing bar into the coupler assembly.

The precast panel system wherein a first precast panel is precast with a plurality of protruding ends of reinforcing bars that are threadably mounted to a first reinforcing bar coupler assembly; a second precast panel also having a plurality of protruding ends of reinforcing bars extending therefrom; the second precast panel adapted to be aligned with the first reinforcing bar coupler assembly of the first precast panel so that when the second precast panel is mounted in the first precast panel, the plurality of protruding ends of reinforcing bars become received in the first reinforcing bar coupler assembly of the first precast panel to which it is aligned.

The method wherein the insert is a split ring assembly that cooperates to secure or clamp against the end portion of the first reinforcing bar in response to the insert being urged axially in the clamp ring.

The method wherein the insert is split, the method comprising the step of situating a spring into engagement with the insert for engaging and urging the insert axially in the first component until it engages and clamps against the end portion of the first one of the plurality of reinforcing bar members.

The method wherein the insert is split, the method further comprising the step of situating a spring between the second component and the insert so that when second component is mounted to the first component, the second component engages the spring and urges the insert tapered outer surface to travel along the clamp ring tapered inner surface to engage and force the insert to clamp onto the portion of the first reinforcing bar, thereby securing the first reinforcing bar to the second reinforcing bar.

The method wherein the method further comprises the steps of situating the insert, the clamp ring and a spring into the first component; mounting the second component onto the first component so that the spring drives the insert axially to couple the first component to the end portion of the first reinforcing bar.

The method wherein the second reinforcing bar comprises a threaded end; the method further comprising the steps of providing a female threaded aperture in the second component; threadably mounting the end portion of the second reinforcing bar into the female threaded aperture; mounting the second component to the first component, thereby coupling the first reinforcing bar to the second reinforcing bar.

The method wherein the method further comprises the step of providing insert comprising a first insert portion and a second insert portion, the first and second insert portions cooperating to define the insert, each of the first and second insert portions comprising a generally curved inner wall for engaging and applying a clamping force against the portion of the first one of the plurality of reinforcing bars when the insert is forced to move axially thereby causing the first and second insert portions to move toward each other and clamp against the first reinforcing bar; each of the first and second inserts also having a tapered wall portion that cooperates to define the insert tapered outer surface.

The method wherein first and second inserts further comprise a shoulder adapted to receive and support a spring, thereby enabling the insert to be received in the clamp ring so that the spring may apply an axial driving force to the insert when the second component is mounted onto the first component to clamp the method to the first reinforcing bar.

The method wherein the method further comprising the step of providing insert comprising teeth on the insert interior wall for engaging the end portion of the first reinforcing bar so that when the first component and a spring apply an axial force to the insert when the second component is mounted onto the first component.

The method wherein the insert and the clamp ring are dimensioned and adapted to permit at least one of the insert to move within the clamp ring or permits the claim ring to move within the first component to allow for horizontal (as viewed in the figures) variability in placement of the first reinforcing bar and to accommodate allow for variability in placing of the first reinforcing bar into the insert.

The method wherein the method further comprises the steps of providing a first precast channel having the second reinforcing bar therein and a second precast panel having the first reinforcing bar therein; situating the insert and clamp ring into a first component; situating a spring into the first component into engagement with the insert; mounting the second component onto the first component to provide a coupler assembly; mounting the end portion of the second reinforcing bar to the second component; inserting the end portion of the first reinforcing bar into the insert receiving area of the insert to mount the end portion of first reinforcing bar to the coupler assembly to thereby coupled the first precast channel to the second precast channel.

These and other objects and advantages of the invention will be apparent from the following description, the accompanying drawings, and the appended claims.

BRIEF DESCRIPTION OF THE ACCOMPANYING DRAWINGS

Figure 5A:
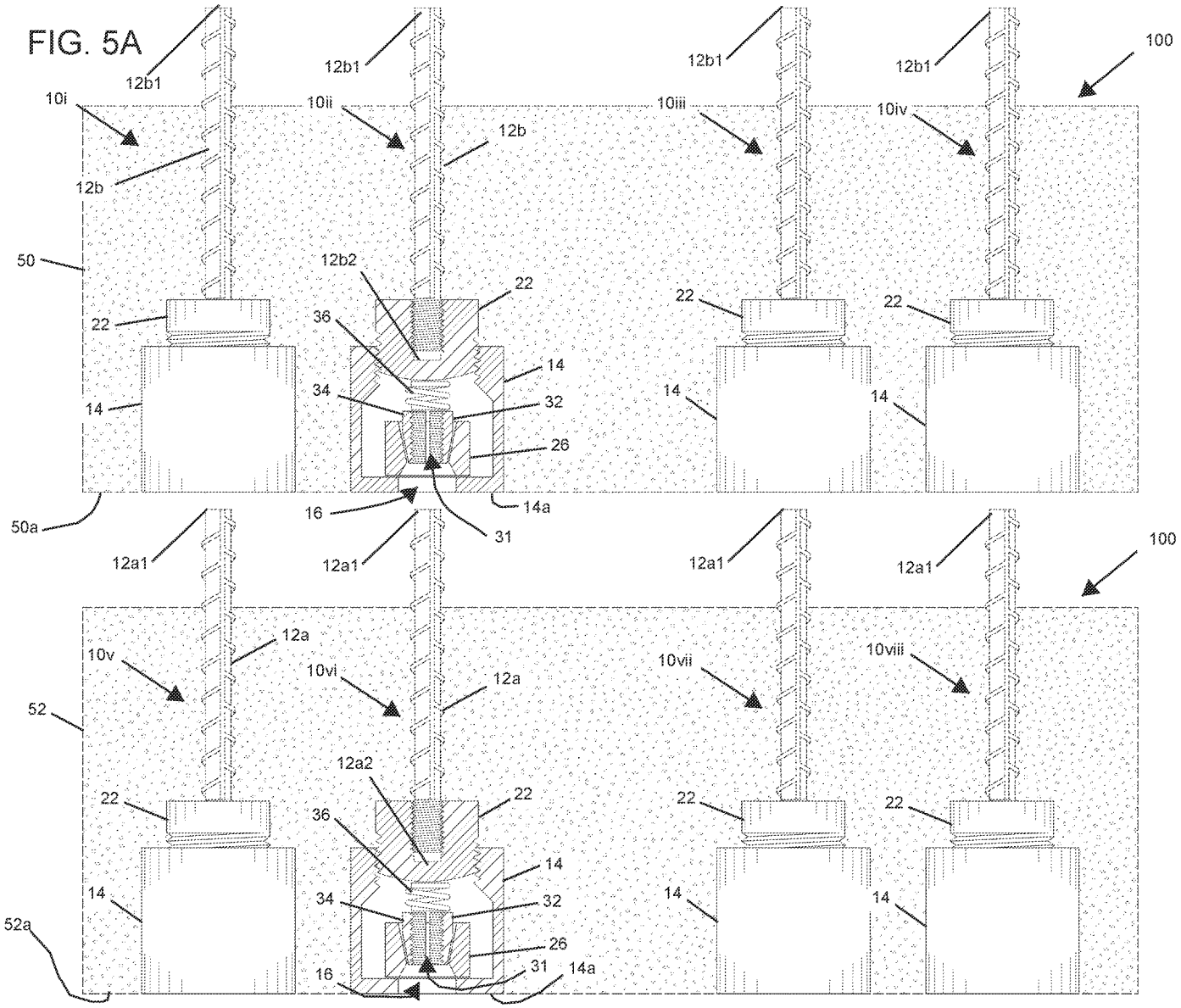
Figure 5B:
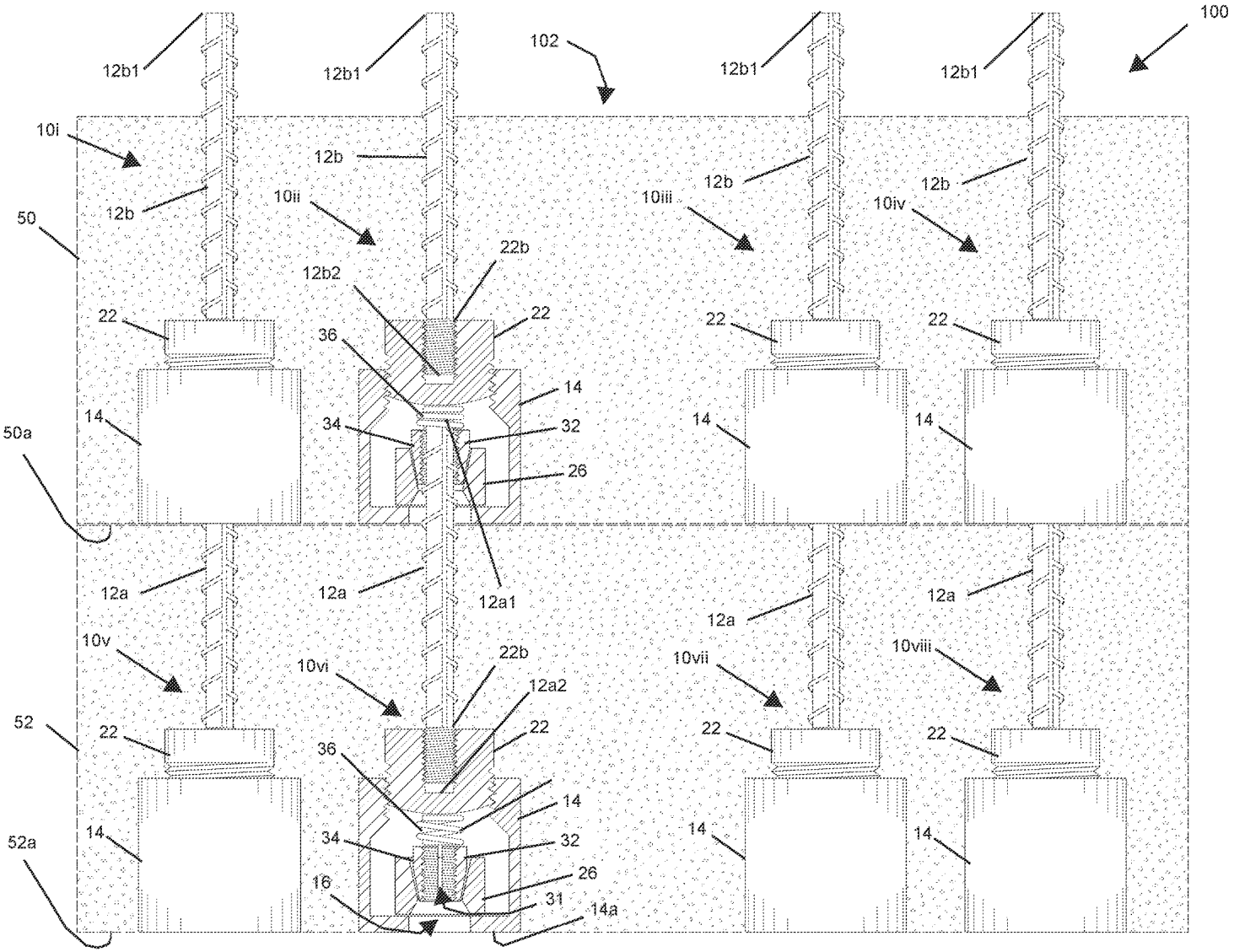
Figure 6:
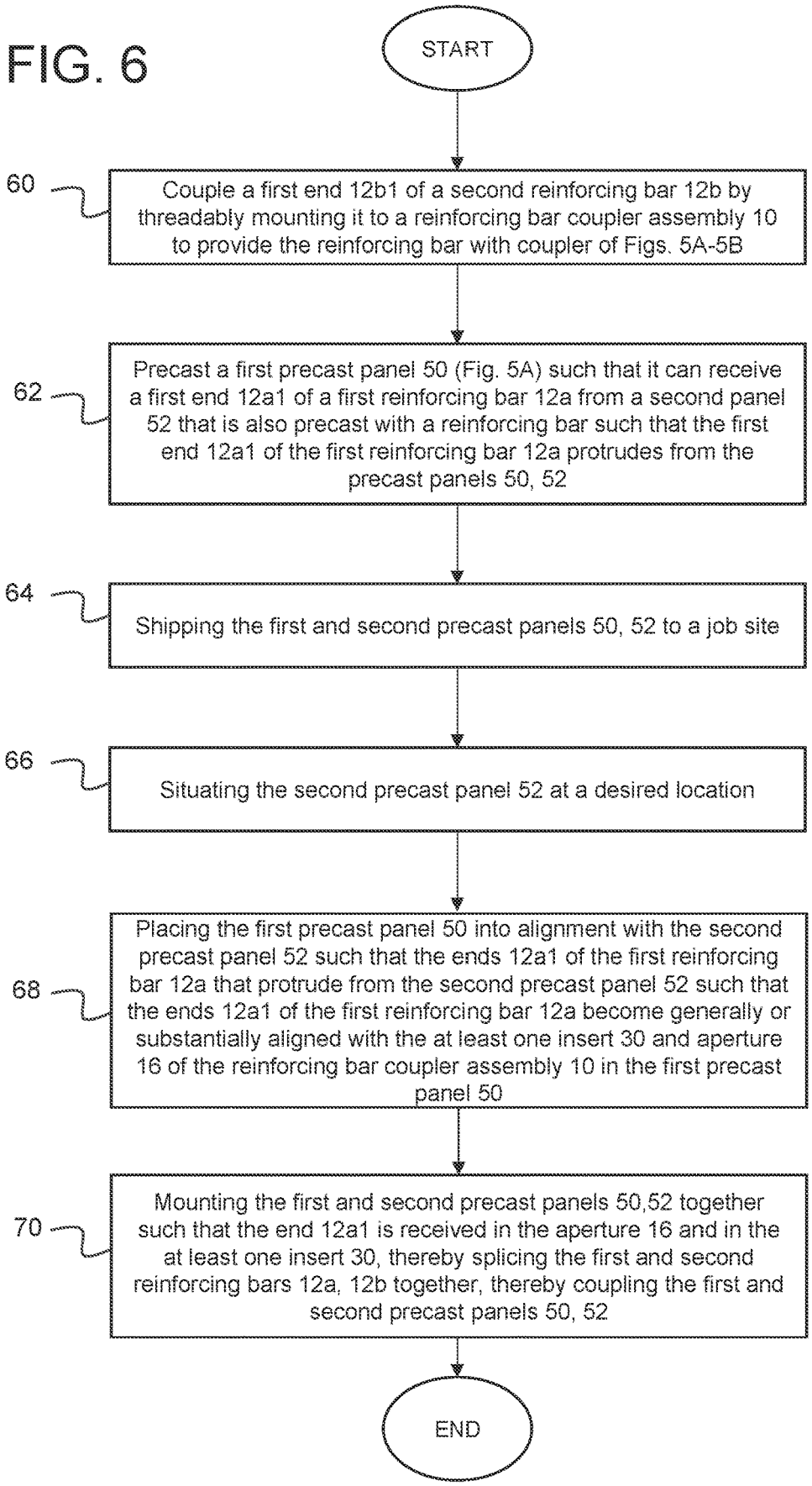

FIGS. 5A and 5B illustrate a plurality of precast panels and a methodology for mounting the precast panels together and a second reinforcing bar coupled to a reinforcing bar coupler assembly and precast into a first precast panel such that the reinforcing bar coupler assembly is positioned in the first precast panel so that it can receive an end of the first reinforcing bar from a precast panel as illustrated; and FIG. 6 is a methodology or process of the invention for manufacturing and installing the precast panels.

DETAILED DESCRIPTION OF THE PREFERRED EMBODIMENTS

Referring now to FIGS. 1A-6, a reinforcing bar coupler assembly 10 and method for coupling a first one of a plurality of reinforcing bars 12*a* and a second one of the plurality of reinforcing bars 12*b* together will now be described. The reinforcing bar coupler assembly 10 is shown in an assembled form in FIGS. 3 and 4A-4C, which will be described later herein. Each of the plurality of reinforcing bars 12*a* and 12*b* comprise a non-threaded end 12*a*1 and 12*b*1, and a threaded end 12*a*2, 12*b*2, respectively. As will be described later herein, this reinforcing bar coupler assembly 10 is precast with the first one and the second one of the plurality of reinforcing bars 12*a* and 12*b* that are mounted into a cement precast panel 50 and 52 of the type shown in FIGS. 5A-5B.

Figure 1A:
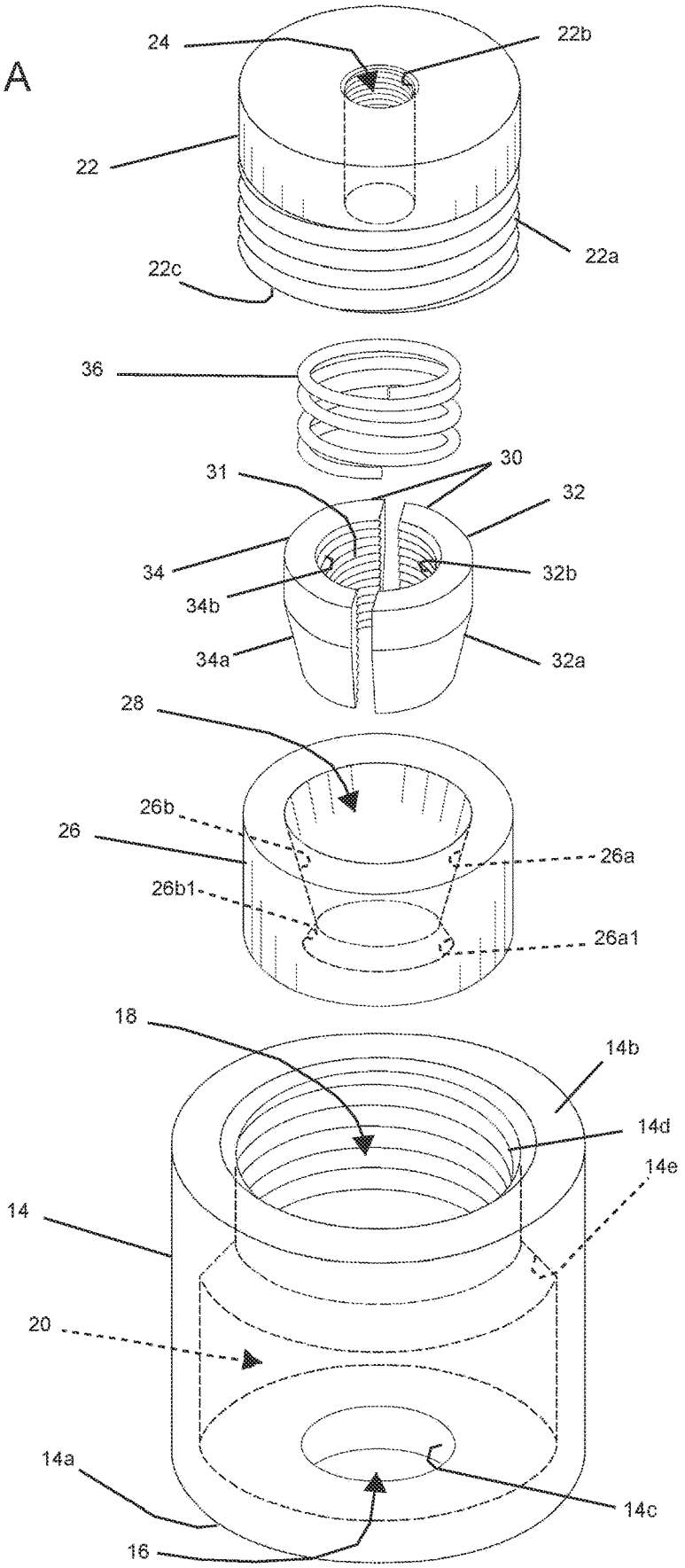
FIG. 1A is an exploded perspective view of an embodiment of a reinforcing bar coupler assembly.
Figure 1B:
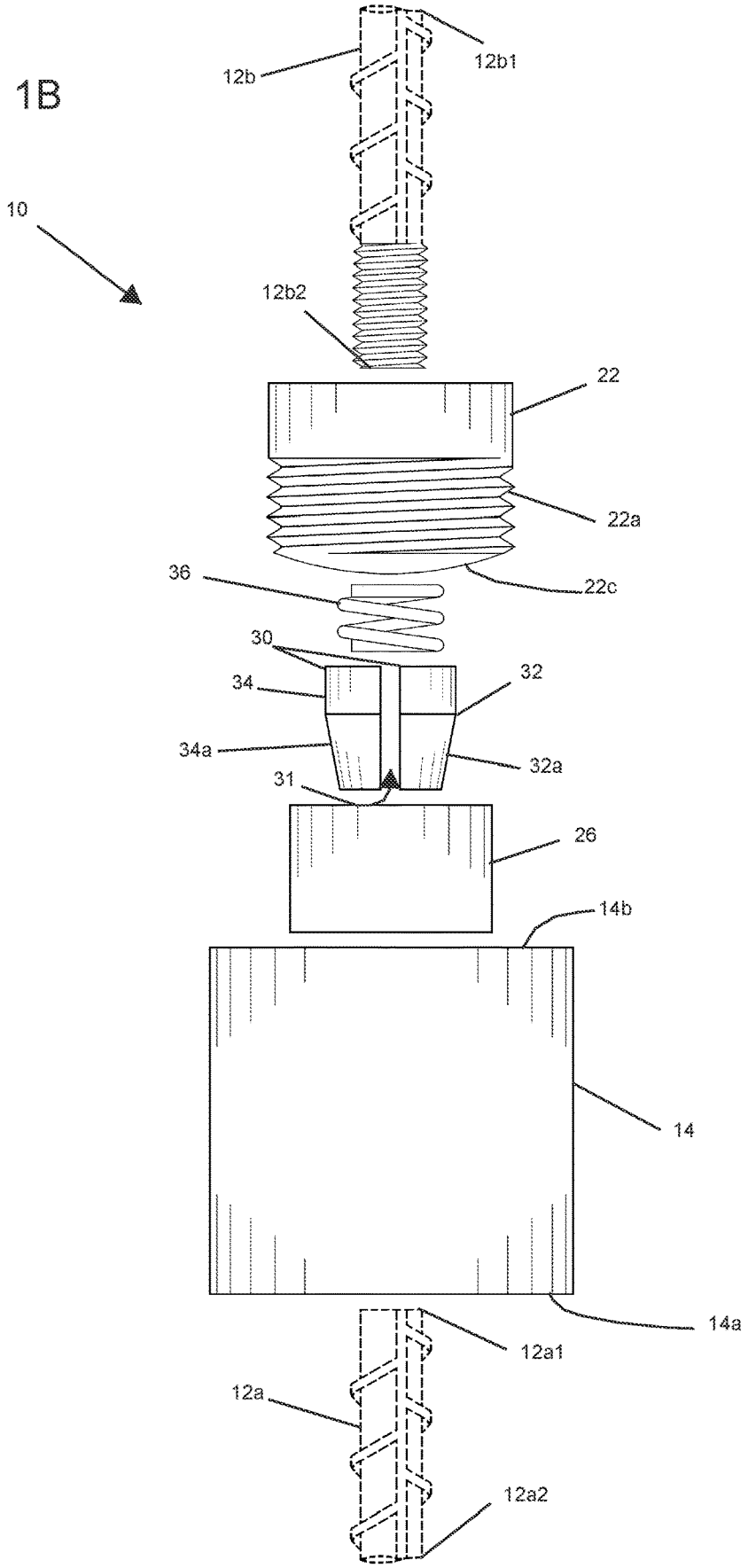
FIG. 1B is also an exploded view of the embodiment shown in FIG. 1A.
Figure 2:
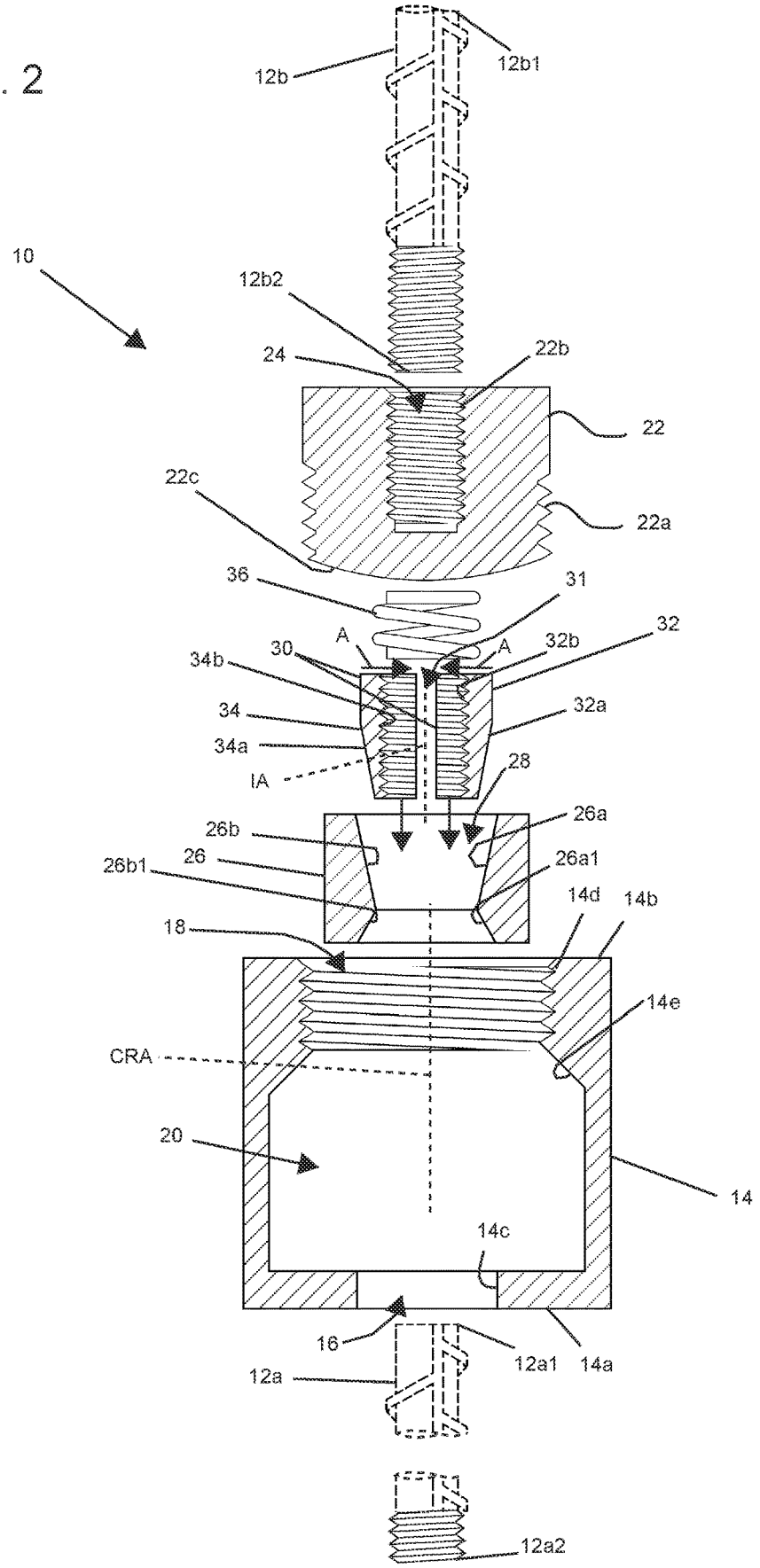
FIG. 2 is another exploded view, similar to FIG. 1B, but in sections showing various details of the components of the reinforcing bar coupler assembly.

Referring now to FIGS. 1A-2, note that the reinforcing bar coupler assembly 10 comprises a generally cylindrical first component 14 that has a first end 14*a* and a second end 14*b*. The first end 14*a* has an interior circular wall 14*c* that defines an aperture 16 through which an end 12*a*1, which is not threaded, of the first one of the plurality of the reinforcing bars 12*a* may be inserted as described herein. Notice that the aperture 16 is larger than a diameter of the first one of the plurality of reinforcing bars 12*a* to allow for offset or varying of tolerances for reinforcing bars that are not exactly aligned as will be described later herein.

A threaded wall 14*d* in the second end 14*b* defines a threaded female aperture 18 that is in communication with an internal receiving area 20 that is sized and adapted to receive various components as described herein. The threaded wall 14*d* is in communication with an interior wall 14*e* and the receiving area 20 inside the first component 14 for housing the various components of the reinforcing bar coupler assembly 10. The threaded female aperture 18 is sized and adapted to threadably receive a second component 22 as described later.

As will be described later, the second component 22 defines an end cap that has a threaded male end 22*a* and an engaging and camming surface 22*c* which will be described later herein. Note that the second component 22 has an interior threaded wall or surface 22*b* that defines a female threaded aperture 24 that is sized and adapted to threadably receive a threaded male end 12*b*2 of the second one of the plurality of reinforcing bars 12*b*. During use, the second component 22 threadably receives and is threadably mounted to the second one of the plurality of reinforcing bars 12*b* to secure the second one of the plurality of reinforcing bars 12*b* thereto.

The reinforcing bar coupler assembly 10 further comprises at least one generally cylindrical clamp ring 26 that is adapted and sized to be received in the internal receiving area 20. The clamp ring 26 comprises a first internal tapered wall 26*a* and a second internal tapered wall 26*b*. The first internal tapered wall 26*a* is frustoconical in shape and defines a camming surface 26*a*1 whose function will be described later herein. The second internal tapered wall 26*b* is also frustoconical in shape and defines a camming surface 26*b*1 whose function will be described later herein. The clamp ring 26 comprises an insert receiving area 28 for receiving insert 30 in the insert receiving area 28. In the illustration being described, the insert 30 comprises a generally curved first insert member 32 and a second insert member 34 that cooperates to clamp a non-threaded end 12*a*1 of the first one of the plurality of reinforcing bars 12*a*. It should be appreciated that a first end 12*a*1 of the second one of the plurality of reinforcing bars 12*a* is not threaded yet is retained in the reinforcing bar coupler assembly 10 by the clamping action described herein. In contrast, notice that the second end 12*a*2 of the first one of the plurality of reinforcing bars 12*a* is threaded as described later is mounted to another second component 22 as shown in FIGS. 5A-5B.

Note that the first and second insert members 32 and 34 of the insert 30 each comprise a tapered wall 32*a* and 34*a* that engage the tapered wall 26*b*. When the insert 30 is urged downward (as viewed in FIG. 2) by a spring 36, which is forced downward by the second component 22, this forces the insert 30 into the clamp ring 26. As it is inserted into the clamp ring 26, the walls 32*a* and 34*a* engage the surfaces 26*a*1 and 26*b*1 so that the first and second insert members 32 and 34 are urged toward each other in order to clamp the end 12*a*2 of the first one of the plurality of reinforcing bars 12*a*. Notice that the insert 30 is defined by the first and second insert members 32 and 34 having an interior tapered engaging wall 32*b* and 34*b*. The walls 32*b* and 34*b* have raised projections or serrations 32*b*1 and 34*b*1 as mentioned earlier that engage the unthreaded end 12*a*2 of the first one of the plurality of reinforcing bars 12*a*. To facilitate such clamping, the inner surfaces or walls 32*b* and 34*b* may be serrated or comprise raised surfaces, teeth, barbs or projections 32*b*1 and 34*b*1 to facilitate such clamping as shown in FIG. 3.

During use, the second one of the plurality of reinforcing bars 12*b* is threadably mounted to the second component 22 by threading the threaded end 12*b*1 of the second one of the plurality of reinforcing bars 12*b* into the threaded aperture 24 defined by the threaded wall or surface 22*b*.

Although not shown, other means for securing the second end 12*b*2 or second end 12*a*2 may be used to secure them to the second component 22, such as swaging, a weld or other means for securing the second component 22 to the second end 12*b*2 of the second one of the plurality of reinforcing bars 12*b* as described herein. Notice that when the reinforcing bar coupler assembly 10 is assembled as shown in FIGS. 3-4C, for example, the tapered walls 32*a* and 34*a* of the insert 30 engage the circular frustoconical wall or surfaces 26*a*1 and 26*b*1 as shown in FIGS. 2 and 3. After the second component 22 is threadably mounted to the first component 14, as illustrated in FIG. 3, it urges the spring 36 to apply the compressive clamping force and urging force downward (as viewed in the figure) which in turn causes the insert 30 to not only move downward (as viewed in the figure), but also move laterally toward each other as indicated by the arrows A in FIG. 3. This lateral movement of the insert members 32 and 34 to cause their walls 32*b* and 34*b* and serrations 32*b*1 and 34*b*1 to be urged together and into direct engagement with the end 12*a*1 of the first one of the plurality of reinforcing bars 12*a*, thereby securing the first one of the plurality of reinforcing bars 12*a* to the second one of the plurality of reinforcing bars 12*b* and to cause their associated precast panels 50 and 52 (FIGS. 5A-5B) to be secured and coupled together as described later.

Figure 3:
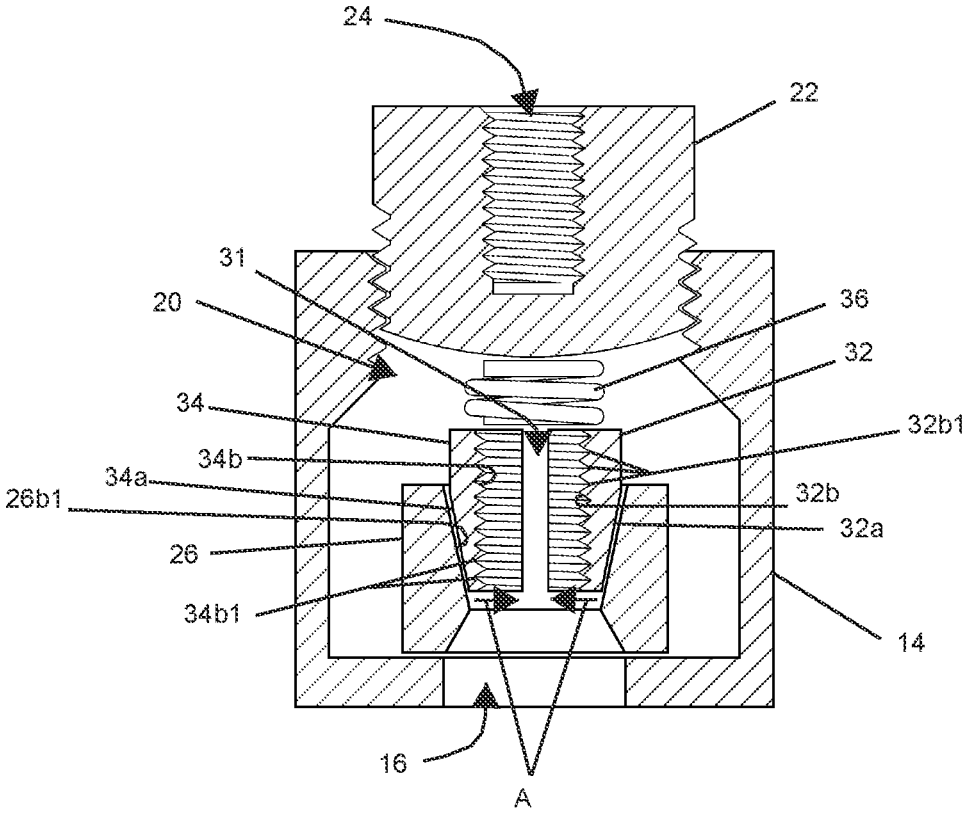
FIG. 3 is a sectional view illustrating various details of the reinforcing bar coupler assembly and the insert that cooperates with a clamp ring to clamp against an end of a reinforcing bar.
Figures 4A, 4B, 4C:
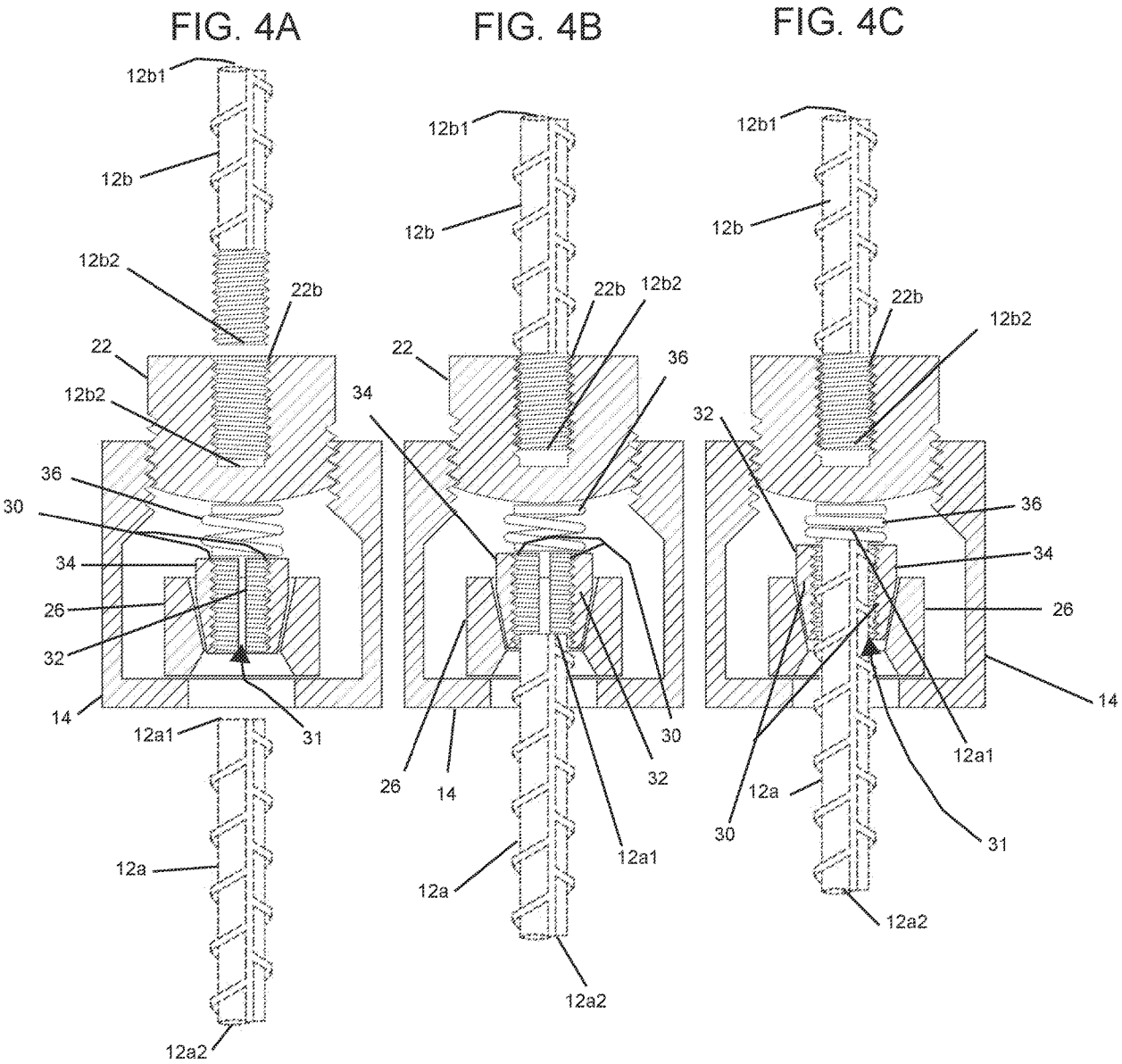
FIGS. 4A-4C are sectional views illustrating a second reinforcing bar threadably mounted to a second component of the reinforcing bar coupler assembly and then a first reinforcing bar secured to the second reinforcing bar and the reinforcing bar coupler assembly by a clamping force.

Notice in FIG. 3 that after the reinforcing bar coupler assembly 10 is assembled, the tapered wall 26*a* of the clamp ring 26 becomes aligned with the generally circular wall 14*c* as illustrated. Conveniently, as the first end 12*a*1 of the first one of the plurality of reinforcing bars 12*a* is inserted into the aperture 16 of the first component 14, and the end 12*a*1 is guided into the insert 30 by the tapered wall 26*a*. As will be described later herein, this facilitates mounting the second end 12*a*2 of the first one of the plurality of reinforcing bars 12*a* to the reinforcing bar coupler assembly 10 and to the second one of the plurality of reinforcing bars 12*b* which is threadably mounted to the second component 22.

It should be noted that the insert 30 comprises an insert axis IA (FIG. 2) that becomes generally aligned with or generally co-axial to a clamp ring passageway axis CRA after first one of the plurality of reinforcing bars 12*a* is received in the receiving area 20. It should also be appreciated that the clamp ring 26 and the insert 30 can "float" or move horizontally (as viewed in FIG. 3) to accommodate variation in tolerances in the positioning and coupling of the plurality of reinforcing bars 12*a* and 12*b*.

Thus, it should be understood that the insert 30 comprises the insert tapered outer surface or walls 32*a* and 34*a* that engage and cooperate with the clamp ring tapered inner walls or surfaces 26*a* and 26*b* to cause the interior walls 32*b* and 34*b* to travel along the insert tapered outer surface so that walls 32*a* and 34*a* to travel along the clamp ring tapered inner walls or surfaces 26*a* and 26*b*, thereby causing the insert 30 to engage and clamp against the end 12*a*1 of the first one of the plurality of reinforcing bars 12*a*. As shown, the second component 22 is threadably mounted on the second end 12*b*2 of the second one of the plurality of reinforcing bars 12*b* so that after the second component 22 is mounted on the second one of the plurality of reinforcing bars 12*b*, the second component 22 becomes rigidly secured and coupled thereto. It also becomes rigidly secured and coupled to the first one of the plurality of reinforcing bars 12*a* which is received and mounted to the second component 22 using the clamp ring 26 and insert 30 in cooperation with the spring 36 and second component 22.

Notice that a wall or camming surface 22*c* of the second component 22 is arcuately shaped for engaging with the spring 36, which can move along the surface 22*c* to accommodate different positions or movement and offset the clamp ring 26 and the insert 30. Again, it should be understood that the clamp ring 26, the insert 30 and the spring 36 are loosely received in the internal receiving area 20 and are permitted to move or "float" in the internal receiving area 20. Until all the components are assembled and mounted together in the final environment, which will be described later herein, they are sized and adapted to move and float in the internal receiving area 20 of the first component 14. This has been found to be extremely beneficial in order to facilitate mounting the first one of the plurality of reinforcing bars 12*a* to the second one of the plurality of reinforcing bars 12*b* especially when the second one of the plurality of reinforcing bars 12*b* in the precast panels 50, 52 are not perfectly aligned with the reinforcing bar coupler assembly 10 and the reinforcing bar receiving area 31 located between the insert members 32 and 34.

As will be described later herein, the primary intended uses of the reinforcing bar coupler assembly 10 are in precast panels, such as precast concrete panels 50 and 52 of the type shown in FIGS. 5A-5B. Advantageously, the insert 30 and the members 32 and 34 can move radially or horizontally (as viewed in FIG. 2) to allow for variability in placing of the end 12*a*1 of the first one of the plurality of reinforcing bars 12*a* to the first component 14. It should also be understood that second end 12*a*2 of the first one of the plurality of reinforcing bars 12 and the second end 12*b*2 of the second one of the plurality of reinforcing bars 12*b*, respectively, are threaded and adapted to be threadably mounted in the threaded aperture 24 of the second component 22 to which it is mounted. One key feature of this design is that the threaded coupling allows for adjustment of the position of the second component 22 and the entire reinforcing bar coupler assembly 10 in a vertical plane (as viewed in FIGS. 5A-5B) to provide for variability in overall vertical placement and dimension of the precast panels 50 and 52 during the casting of precast panels 50 and 52.

FIGS. 4A-4C, 5A-5B and 6 illustrate a method for mounting the second one of the plurality of reinforcing bars 12*b* to the first one of the plurality of reinforcing bars 12*a*. Notice in FIG. 4A that the components 14, 22, 26, 30 and 36 are loosely received in the receiving area 20 and the second end 12*b*2 of the second one of the plurality of reinforcing bars 12*b* has not been threadably mounted to the second component 22 yet, and the first end 12*a*1 has not been inserted into the first component 14 yet. FIG. 4A illustrates the first end 12*a*1 of the first one of the plurality of reinforcing bars 12*a* before it is received or inserted into the first component 14. FIG. 4B illustrates the first end 12*a*1 of the first one of the plurality of reinforcing bars 12*a* being partially inserted into the first component 14 and the reinforcing bar coupler assembly 10. Lastly, FIG. 4C illustrates the assembled reinforcing bar coupler assembly 10 after the end 12*b*1 has been threadably mounted and clamped to the reinforcing bar coupler assembly 10 in the second component 22. Notice that the first end 12*a*1 of the first one of the plurality of reinforcing bars 12*a* has been fully inserted into the insert reinforcing bar receiving area 31 (FIG. 4C), thereby causing the first one of the plurality of reinforcing bars 12*a* to be fully secured and mounted to the first component 14 as shown. Notice in FIGS. 4A-4C that as the end 12*a*1 is inserted, it works against the force of the spring 36 which enables the end 12*a*1 to be fully inserted upward (as viewed in the figure). As the first end 12*a*1 of the first one of the plurality of reinforcing bars 12*a* is mounted, inserted or guided between the members 32 and 34 as illustrated in FIG. 4C. The tapered walls 26*a*1 and 26*b*1 facilitate guiding the first end 12*a*1 of the first one of the plurality of reinforcing bars 12*a* into the insert 30 and between the members 32 and 34. The spring 36 provides resistance to this movement but as the precast panels 50 and 52 are stacked, the end 12*a*1 is urged upward (as viewed in FIGS. 4A) and between the members 32 and 34. The force by the spring 36 provides a clamping force to cause the members 32 and 34 to clamp to the end 12*a*1 with enough force so that it cannot withdraw and couples the reinforcing bars 12*a* and 12*b* together as well as their associated precast panels 50 and 52 (FIG. 5A).

Advantageously, and because the various components can "float" inside the internal receiving area 20, these components 26 and 30 may move both radially and horizontally and vertically to allow for variability in placing of the first end 12*a*1 of the first one of the plurality of reinforcing bars 12*a* into the insert 30 and the reinforcing bar coupler assembly 10.

Notice that the aperture 16 defined by the wall 14*c* is dimensioned to be larger than a diameter of the first end 12*a*1 as mentioned earlier. The clamp ring 26 can move in a radial or horizontal (as viewed in FIG. 2) direction, and it becomes aligned with the first end 12*a*1. It should be noted that it does not have to be perfectly co-axially aligned with either the axis IA of the reinforcing bar receiving area 31 between the members 32 and 34 or the insert 30. In general, the clamp ring 26 will always be aligned with the insert 30 in one embodiment. The clamp ring 26 does not have to be aligned with the second one of the plurality of reinforcing bars 12*b* or the second component 22. Again, the spring 36 cooperates with the arcuate surface 22*b* and is permitted to move or float along that surface 22*b* so that it will maintain engagement with the insert 30 and provide the urging force necessary to cause the members 32 and 34 to clamp against the first end 12*a*1 of the first one of the plurality of reinforcing bars 12*a*. Thus, the clamp ring 26, the insert 30 and the spring 36 provide for flexibility and accommodating the plurality of reinforcing bars 12 that are not perfectly aligned. Note that the curved surface 22*b* also permits the spring 36 and components 26 and 30 to "float" horizontally within the first component. This enables the reinforcing bar coupler assembly 10 to be adaptable and usable with the first one of the plurality of reinforcing bars 12*a* and the second one of the plurality of reinforcing bars 12*b* in the precast panels 50, 52 that are not perfectly aligned.

Once the second one of the plurality of reinforcing bars 12*b* becomes permanently coupled to the first one of the plurality of reinforcing bars 12*a* in the reinforcing bar coupler assembly 10, they and their associated precast panels 50 and 52 become coupled together.

During use, the second one of the plurality of reinforcing bars 12*b* is threadably mounted to the second component 22 as described herein and both the second one of the plurality of reinforcing bars 12*b* and the first and second components 14 and 22 are precast in a precast panel, such as precast panels 50, 52 in FIGS. 5A-5B. Thereafter, the first end 12*a*1 of the first one of the plurality of reinforcing bars 12*a* is inserted through the aperture 16 and guided into the internal receiving area 20 whereupon the beveled surfaces or walls 26*a*1 and 26*b*1 of the clamp ring 26 guides the first end 12*a*1 of the first one of the plurality of reinforcing bars 12*a* into the insert 30 securing the end 12*a*1 in the first component 14.

Referring now to FIGS. 5A and 5B, an embodiment is shown illustrating a precast panel system 100 for building a wall or structure 102 (FIGS. 5A-5B). For illustration purposes, the top precast panel 50 and the bottom precast panel 52 are shown. It should be understood that a plurality of precast panels 50 and 52 may be used to construct a precast wall or structure 102. The assembled top and bottom precast panels 50 and 52 form the wall or structure 102 (FIG. 5B). The precast panels 50 and 52 are assembled and mounted together using the reinforcing bar coupler assembly 10 described herein. It should be understood that a plurality of precast panels 50 and 52 may be mounted together to define the planar or non-planar wall or structure 102.

For ease of illustration, the reinforcing bar coupler assembly 10 with the second one of the plurality of reinforcing bars 12*b* threadably mounted thereto are shown housed or precast into the precast panels 50 and 52. Conveniently, note that the first component 14 and second component 22 are assembled together and define a housing for the various internal components, namely the clamp ring 26, insert 30 and spring 36. In general, each precast panel 50 and 52 is precast with a plurality of the reinforcing bar coupler assemblies 10, which are typically spaced and aligned vertically so that one precast panel 50 or 52 can be dropped onto the next precast panel 52, 50, respectively. For ease of illustration and description, each of the precast panels 50 and 52 have four reinforcing bar coupler assemblies 10, which are labeled 10*i*, 10*ii*, 10*iii* and 10*iv*, with the second one of the plurality of reinforcing bars 12*b* already mounted thereto and cast into the precast panels 50 and 52. With each of the reinforcing bar coupler assemblies 10*i*, 10*ii*, 10*iii* and 10*iv* have the male threaded first end 12*b*1 of the second one of the plurality of reinforcing bars 12*b* mounted to the second component 22 as shown. The second component 22 is threadably mounted on the first component 14 with its internal components as shown. For ease of illustration and description, the second reinforcing bar coupler assembly 10*ii* shown in FIG. 5A is shown in section so that its components and assembly may be easily understood.

It is important to understand that the precast panels 50 and 52 are precast with the reinforcing bar coupler assembly 10 and the second one of the plurality of reinforcing bars 12*b* being mounted thereto and precast directly into the precast panels 50, 52 such that the end 12*a*1 of the first one of the plurality of reinforcing bars 12*a* protrudes therefrom and becomes generally aligned or flush with a bottom surface 50*a* of the top precast panel 50. Notice that the precast panel 52 has the reinforcing bar coupler assemblies 10*v*, 10*vi* and 10*vii* and 10*viii* and first one of the plurality of reinforcing bars 12*a* integral in the precast panel 52 and secured thereto. Again, each reinforcing bar coupler assembly, such as reinforcing bar coupler assembly 10*v*, is precast with the first one of the plurality of reinforcing bars 12*a* secured thereto as described earlier herein. Like the reinforcing bar coupler assembly 10*ii*, notice that each coupler assembly 10*i*-10*viii*, such as the reinforcing bar coupler assembly 10*v* in the precast panel 52, has the end 14*a* of the first component 14 generally aligned with and co-planar with a bottom edge or surface 52*a* of the precast panel 52. Likewise, the end 14*a* of the first component 14 is generally aligned or "flush" with the edge 50*a*.

In general, the precast panels 50 and 52 are cast with the threaded reinforcing or second one of the plurality of reinforcing bars 12*b* and the reinforcing bar coupler assembly 10 placed in the precast panel 50 at the precast yard where the precast panels 50 and 52 are made. The precast panels 50 and 52 are then transported or shipped to a job site (not shown) with a bottom precast panel, such as precast panel 52 in FIGS. 5A and 5B, and then the top precast panel 50 is aligned with and then lowered onto or over the bottom precast panel 52 as illustrated in FIG. 5B. The end 12*a*1 of the first one of the plurality of reinforcing bars 12*a* becomes generally aligned with an associated aperture, such as aperture 16. As illustrated earlier herein, the frustoconical or tapered wall 26*a*1 facilitates guiding the end 12*a*1 toward and into the insert reinforcing bar receiving area 31. Thus, notice during assembly, the precast panels 50 and 52 are aligned such that the protruding ends 12*a*1 of the precast panel 52 are aligned with the corresponding apertures 16 of the mating reinforcing bar coupler assemblies 10*i*-10*iv* of the precast panel 50 as shown.

As described earlier herein, the clamp ring 26, insert 30 and the at least one spring 36 can float inside the receiving area 20 to accommodate misaligned ends 12*a*1 that are not exactly co-axial with either the axis of the second one of the plurality of reinforcing bars 12*b* or the insert axis IA. In any event, this floating design permits these components to move inside the receiving area 20 yet still permit the spring 36 and the insert 30 to engage and clamp against the end 12*a*1 of the first one of the plurality of reinforcing bars 12*a*. Notice that after the top precast panel 50 is mounted onto the bottom precast panel 52, the first one of the plurality of reinforcing bars 12*a* and the second one of the plurality of reinforcing bars 12*b* become secured together, thereby securing the precast panels 50, 52 together. Other precast panels may then be mounted on top of precast panel 50 as the wall construction continues.

It should be appreciated that the precast panels 50 and 52 are typically planar, but could have other shapes and dimensions, such as generally cylindrical, square, polygonal, rectangular as shown or the like. Thus, the precast panels 50 and 52 could comprise other configurations if desired. Thus, although the embodiments illustrated in FIGS. 5A and 5B show two precast panels 50 and 52 assembled, it should be appreciated that a plurality of precast panels could be assembled and stacked to define the wall or structure 102 (FIG. 5B).

Referring now to FIG. 6, a process or routine for coupling a plurality of precast panels 50, 52 utilizing the reinforcing bar coupler assembly 10 will now be described. The process or routine begins at block 60 when a first end 12*b*1 of the second one of a plurality of reinforcing bars 12*b* is threadably mounted to the second component 22 of the reinforcing bar coupler assembly 10 to provide a reinforcing bar with the reinforcing bar coupler assembly 10 as illustrated in FIGS. 5A-5B. The routine continues to block 62 wherein the top precast panel 50 is manufactured or cast with the second one of a plurality of reinforcing bars 12*b* and reinforcing bar coupler assembly 10 cast therein. The precast panel 52 is similarly constructed such that the first ends 12*a*1 of the first one of a plurality of reinforcing bars 12*a* protrude from each of the top and bottom precast panels 50, 52.

Once the precast panels 50, 52 are precast, they are shipped to a job site where the structure 102 can be constructed (block 64). In this regard, the bottom precast panel 52 is situated at a desired location at the job site (block 66). The routine continues to block 68 where the precast panel 50 is placed into alignment with the precast panel 52 such that the end 12*a*1 of the first one of a plurality of reinforcing bars 12*a* that protrude from the precast panel 52 become generally or substantially aligned with the insert 30 and aperture 16 of the reinforcing bar coupler assembly 10 to which it is aligned in the precast panel 50.

At block 70, the precast panels 50 and 52 are mounted together such that the end 12*a*1 of the first one of a plurality of reinforcing bars 12*a* is received in the aperture 16 and the insert 30, thereby splicing and coupling the first one of a plurality of reinforcing bars 12*a* and the second one of a plurality of reinforcing bars 12*b* and the precast panels 50, 52 together.

The routine proceeds for each precast panel 50, 52 that must be mounted to define the structure 102.

ADDITIONAL CONSIDERATIONS

1. It should be understood that the insert 30 may be comprised of multiple insert members 32 and 34 (for example, three or more, not shown). The important thing is that the insert 30 engages and clamps against the end 12*a*1 once the first one of the plurality of reinforcing bars 12*a* is inserted in the reinforcing bar coupler assembly 10. Alternatively, the insert 30 could be a one-piece construction that is adapted and sized to receive the first end 12*a*1 of the first one of the plurality of reinforcing bars 12*a* in the receiving area 31. In such an embodiment, the insert 30 is deformable as the insert 30 is urged into the receiving area 28 and its wall is forced downward, the insert 30 deforms and clamps against the end 12*a*1.

This invention, including all embodiments shown and described herein, could be used alone or together and/or in combination with one or more of the features covered by one or more of the claims set forth herein, including but not limited to one or more of the features or steps mentioned in the Summary of the Invention and the claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A reinforcing bar coupler assembly for coupling a plurality of reinforcing bars together, the reinforcing bar coupler assembly comprising:

a first component comprising an internal receiving area;

a clamp ring for situating in said internal receiving area, said clamp ring comprising an insert receiving area and defining a clamp ring passageway in communication with said insert receiving area and a clamp ring passageway axis, said clamp ring comprising a clamp ring tapered or frusto-conical inner surface;

an insert comprising an insert reinforcing bar receiving area defined by an insert interior wall that is adapted and sized to receive a first one of said plurality of reinforcing bars in said insert receiving area, said insert having an insert axis that becomes generally aligned with or generally coaxial with said clamp ring passageway axis so that after said first one of said plurality of reinforcing bars is received in said insert reinforcing bar receiving area, said insert comprising an insert tapered outer surface that engages and cooperates with said clamp ring tapered or frusto-conical inner surface to cause said insert interior wall to apply a compressive force against a portion of said first one of said plurality of reinforcing bars in response to said insert being urged into said clamp ring; and a second component for mounting onto said first component, said second component being adapted to urge a spring into engagement with said insert to drive said insert into said insert receiving area when said second component is mounted onto said first component, said engaging and clamping against said portion of said first one of said plurality of reinforcing bars in response thereto; said second component being adapted to be mounted to a threaded first end of a second one of said plurality of reinforcing bars so that after said reinforcing bar coupler assembly is mounted on said second one of said plurality of reinforcing bars and said first one of said plurality of reinforcing bars is secured or clamped to said second one of said plurality of reinforcing bars, said first one and said second one of plurality of reinforcing bars become coupled and secured together;

wherein said insert and said clamp ring are dimensioned and adapted to permit said clamp ring to be received in said internal receiving area of said first component said clamp ring being adapted to float or move within said internal receiving area of said first component after said insert is received in said clamp ring to accommodate and allow for variability in placing of said portion of said first one of said plurality of reinforcing bars into said reinforcing bar coupler assembly and also allow for at least one of radial, horizontal and vertical movement of said clamp ring in said internal receiving area of said first component.

2. The reinforcing bar coupler assembly as recited in claim 1 wherein said insert is a split ring assembly that cooperates to secure or clamp against a portion of said first one of said plurality of reinforcing bars in response to said insert being urged axially in said clamp ring.

3. The reinforcing bar coupler assembly as recited in claim 1 wherein said reinforcing bar coupler assembly comprising a spring that engages and said spring urges said insert until it engages and clamps against said portion of said first one of said plurality of reinforcing bars.

4. The reinforcing bar coupler assembly as recited in claim 3 wherein said spring is situated between said second component and said insert so that when said second component is mounted to said first component, said second component engages said spring and urges said insert tapered outer surface to engage and force said insert to clamp onto said portion of said first one of said plurality of reinforcing bars, thereby securing said first one of said plurality of reinforcing bars to said second one of said plurality of reinforcing bars.

5. The reinforcing bar coupler assembly as recited in claim 3 wherein said insert is received in said clamp ring and said spring applying an axial force to said insert when said second component is mounted onto said first component.

6. The reinforcing bar coupler assembly as recited in claim 1 wherein said second component comprises a threaded aperture adapted to receive a threaded end of said second one of said plurality of reinforcing bars.

7. The reinforcing bar coupler assembly as recited in claim 1 wherein said insert comprising a first insert portion and a second insert portion, said first and second insert portions cooperating to define said insert, each of said first and second insert portions comprising a generally curved inner wall or surface for engaging and applying a clamping force against said portion of said first one of said plurality of reinforcing bars, each of said first and second insert portion also having a tapered wall portion that cooperate to define said insert tapered outer surface.

8. The reinforcing bar coupler assembly as recited in claim 7 wherein first and second inserts further comprise a shoulder adapted to receive and support a spring, thereby enabling said insert to be received in said clamp ring so that said spring may apply an axial driving force to said first and second inserts when said second component is mounted onto said first component.

9. The reinforcing bar coupler assembly as recited in claim 7 wherein said generally curved inner wall or surface comprises teeth or projections for engaging said first one of said plurality of reinforcing bars.

10. The reinforcing bar coupler assembly as recited in claim 1 wherein a first precast panel is precast with a plurality of protruding ends of reinforcing bars that are threadably mounted to said first reinforcing bar coupler assembly;

a second precast panel also having a plurality of protruding ends of reinforcing bars extending therefrom;

said second precast panel adapted to be aligned with said first reinforcing bar coupler assembly of said first precast panel so that when said second precast panel is mounted in said first precast panel, said plurality of protruding ends of reinforcing bars become received in said first reinforcing bar coupler assembly of said first precast panel to which it is aligned.

11. A method of making a coupler adapted to rigidly connect end portions of a first reinforcing bar and a second reinforcing bar, said first and second reinforcing bars being adapted to be used with concrete, said method comprising the steps of:

providing a first component comprising an internal receiving area;

situating a clamp ring into said internal receiving area, said clamp ring comprising a clamp ring receiving area defined by a clamp ring tapered inner surface;

situating an insert into said clamp ring receiving area, said insert comprising an insert receiving area defined by an insert interior wall that is adapted and sized to receive an end portion of the first reinforcing bar in said insert receiving area, said insert further comprising an insert tapered outer surface that engages and cooperates with said clamp ring tapered inner surface to cause said insert interior wall to wedge against and engage said clamp ring tapered inner surface against said insert tapered outer surface thereby causing said insert to clamp against and be secured to said first reinforcing bar;

mounting a second component onto said an end portion of the second reinforcing bar; mounting said second component to said first component; and wherein when said insert is driven axially into said clamp ring, said second component being adapted to urge a spring into engagement with said insert to drive said insert into said insert receiving area when said second component is mounted onto said first component to edge against and clamp against said end portion of said first reinforcing bar;

wherein said insert and said clamp ring are dimensioned and adapted to permit said clamp ring to be received in said internal in a of said first component aid clamp ring being adapted to float or move within said internal receiving area of said first component after said insert is received in said clamp ring to accommodate and allow for variability in placing of said end portions of said first and second reinforcing bars and also allow for at least one of radial, horizontal and vertical movement of said clamp ring in said internal receiving area of said first component.

12. The method as recited in claim 11 wherein said insert is a split ring assembly that cooperates to secure or clamp against said end portion of said first reinforcing bar in response to said insert being urged axially in said clamp ring.

13. The method as recited in claim 11 wherein said method comprising the step of:

situating said spring into engagement with said insert for engaging and urging said insert axially in said first component until it engages and clamps against said end portion of said first one of said plurality of reinforcing bar members.

14. The method as recited in claim 11 wherein said method further comprising the step of:

situating said spring between said second component and said insert so that when second component is mounted to said first component, said second component engages said spring and urges said insert tapered outer surface to engage and force said insert to clamp onto said portion of said first reinforcing bar, thereby securing said first reinforcing bar to said second reinforcing bar.

15. The method as recited in claim 11 wherein said method further comprises the steps of:

situating said insert, said clamp ring and said spring into said first component;

mounting said second component onto said first component so that said spring drives said insert axially to couple said first component to said end portion of said first reinforcing bar.

16. The method as recited in claim 15 wherein said second reinforcing bar comprises a threaded end; said method further comprising the steps of:

providing a female threaded aperture in said second component;

threadably mounting said end portion of said second reinforcing bar into said female threaded aperture;

mounting said second component to said first component, thereby coupling said first reinforcing bar to said second reinforcing bar.

17. The method as recited in claim 11 wherein said method further comprises the step of:

providing said insert comprising a first insert portion and a second insert portion, said first and second insert portions cooperating to define said insert, each of said first and second insert portions comprising a generally curved inner wall for engaging and applying a clamping force against said portion of said first one of said plurality of reinforcing bars when said insert is forced to move axially thereby causing said first and second insert portions to move toward each other and clamp against said first reinforcing bar;

each of said first and second insert portions also having a tapered wall portion that cooperates to define said insert tapered outer surface.

18. The method as recited in claim 17 wherein first and second inserts further comprise a shoulder adapted to receive and support said spring, thereby enabling said insert to be received in said clamp ring so that said spring may apply an axial driving force to said insert when said second component is mounted onto said first component to clamp said method to said first reinforcing bar.

19. The method as recited in claim 11 wherein said method further comprising the step of:

providing insert comprising teeth on said insert interior wall for engaging said end portion of said first reinforcing bar so that when said first component and said spring apply an axial force to said insert when said second component is mounted onto said first component.

20. The method as recited in claim 11 wherein said method further comprises the steps of:

providing a first precast panel having said second reinforcing bar therein and a second precast panel having said first reinforcing bar therein;

situating said insert and clamp ring into said first component;

situating said spring into said first component into engagement with said insert;

mounting said second component onto said first component to provide a coupler assembly;

mounting said end portion of said second reinforcing bar to said second component;

inserting said end portion of said first reinforcing bar into said insert receiving area of said insert to mount said end portion of first reinforcing bar to said coupler assembly to thereby coupled said first precast panel to said second precast panel.

* * * * *